United States Patent [19]

Solomon

[11] Patent Number: 5,054,786

[45] Date of Patent: Oct. 8, 1991

[54] TETHERED GOLF BALL

[76] Inventor: Bart R. Solomon, 2325 Old Shakopee Rd., Bloomington, Minn. 55425

[21] Appl. No.: 533,273

[22] Filed: Jun. 4, 1990

[51] Int. Cl.[5] ..... A63B 69/36

[52] U.S. Cl. ..... 273/200 R; 273/58 C; 273/196

[58] Field of Search ..... 273/200 R, 200 B, 200 A, 273/198, 58 C, 184 B, 185 C, 185 D

[56] References Cited

U.S. PATENT DOCUMENTS

| | | | |
|---|---|---|---|
| 1,326,976 | 1/1920 | Schnurr | 273/200 R |
| 1,446,641 | 2/1923 | Craig | 273/200 R |
| 1,541,420 | 6/1925 | Lambert | 273/200 R |
| 1,700,224 | 1/1929 | Hendersen | 273/200 R |
| 2,529,771 | 11/1950 | Herman | 273/198 |
| 3,425,700 | 2/1969 | Edwards | 273/58 C |
| 3,502,337 | 3/1970 | Butkus | 273/200 R |
| 3,521,887 | 7/1970 | Butkus | 273/200 R |
| 3,804,409 | 4/1974 | Schachner | 273/58 C |
| 4,095,798 | 6/1978 | Marple | 273/200 R |
| 4,660,835 | 4/1987 | Lucurto | 273/200 R |

FOREIGN PATENT DOCUMENTS 358792 10/1931 United Kingdom ..... 273/200 R

*Primary Examiner*—George J. Marlo
*Attorney, Agent, or Firm*—Donald A. Jacobson

[57] ABSTRACT

A golf sling, using a tether made up of a joined resilient and a non-resilient line, uses a conventional golf ball attached to one end and an anchor attached to the opposite end to permit practicing golf in a limited area. A connector from the tether to an anchor permits using either a pin forced into the ground or a snap attached to a golf bag as an anchor. An adjustable device for the length of the resilient section permits selecting a length to change the tether characteristics appropriate to the club in use. The resilient portion can be made of a plastic coil or an elastic strap. A modification to the coil uses a spring through the coil to permit selecting a spring constant separate from the damping constant for greater flexibility. The golf ball can be permanently attached to the tether, or can be adapted to be readily changed by a variety of attachment devices. A tee and a tee holding ring can be attached to the tether for golf club wood use.

1 Claim, 5 Drawing Sheets

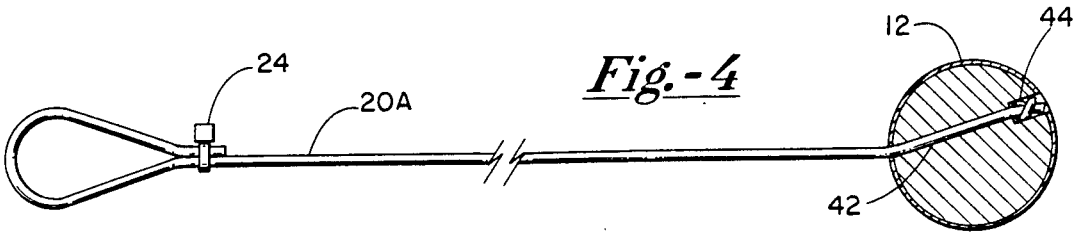
Fig.-4
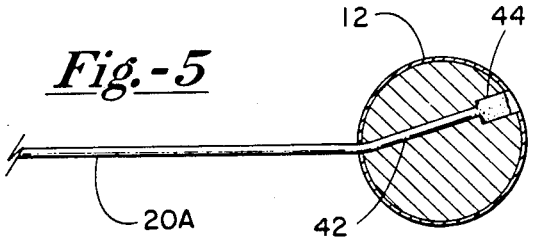
Fig.-5
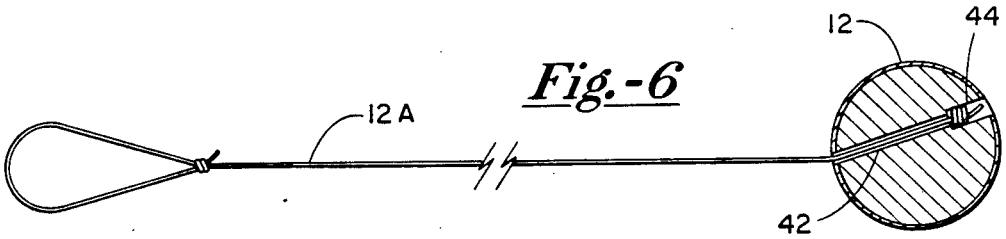
Fig.-6
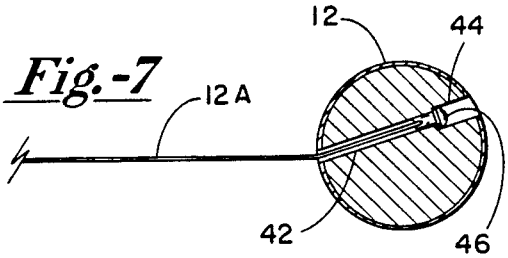
Fig.-7
Fig.-7A
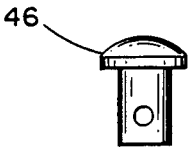

TETHERED GOLF BALL

FIELD OF THE INVENTION

This invention relates to an apparatus using a tethered golf ball to practice a golf swing. The apparatus can be modified to match swing requirements for the various clubs.

BACKGROUND OF THE INVENTION

There are a number of previous inventions which provide a tethered golf ball. For example, in Locurto, U.S. Pat. No. 4,660,835 a force spreading member, which is a sector of a spherical shell, is in intimate contact with a golf ball. An eye hook is connected to the golf ball. A three section cable is attached between the eye hook and a tether to tether the golf ball. In Marple, U.S. Pat. No. 4,095,798 a heavy duty metal stake has a helical screw portion which is turned into the ground to secure a swivel member. The swivel member is connected to a heavy rubber strap on one end, with the other end connected to one end of a nylon cord. The other end of the nylon cord is removably attached to a staple imbedded in a standard wound rubber core golf ball. In Schnurr, U.S. Pat. No. 1,326,976 a screw eye is secured within a hole which is countersunk into a golf ball. A tether cord made up of a short resilient section and a long light cord section attaches the screw eye to a tethering pin to tether the golf ball to the ground. In Craig, U.S. Pat. No. 1,446,641 a cable is passed through and headed beyond a golf ball and a helical wound flexible reinforcing member is attached to the cable to provide a means of securing the ball. In Lambert, U.S. Pat. No. 1,541,420 a golf ball is secured to a tether which is secured to a return spring. A housing is provided for the return spring. In Butkus, U.S. Pat. No. 3,502,337, a game device has a resiliently tethered ball using two cord sections connected together. One section is elastic and the other relatively nonstretchable. The non-stretchable cord is connected to a tethering pin and the elastic section to a golf ball. In Butkus, U.S. Pat. No. 3,521,887, a game device made up of a resiliently tethered ball using multiple tether elements is taught. This device uses two separate and independent tethering pins which are moveable relative to each other with respect to the ground or any other support. A tether cord made up of a number of sections connected together is attached to a golf ball and to one of the tethering pins.

None of these previous inventions provide means to: change the tether length for different clubs, replace the ball, provide separate means for the spring means and the damping means, use different anchor means, or to provide tee means.

SUMMARY OF THE INVENTION

A tethered golf sling is used to tether a conventional golf ball to permit realistic practice using any golf club within a limited area. A length adjustment provides the necessary changes in the tether characteristics to obtain realistic practice results using any of the golf clubs. Removable end attachments permit changes in the anchor means. Replacement of the golf ball is also provided.

The tether is made up of a non-resilient portion and a resilient portion with the resilient portion having optional adjustment means to change the length. This length adjustment means permits tailoring the tether to different golf clubs. One embodiment of the tether uses a coil made of plastic with a hollow interior as the resilient portion of the tether. A modification to this embodiment is the use of a spring threaded through the hollow coil to permit an independent selection of the spring and the damping constant for the resilient portion of the tether.

Attachment means on one end of the tether permits using either a golf bag or a pin secured into the ground as an anchor. An attached golf tee with a ring to hold the tee next to the tether when not in use, provides an ever present tee for use with a driver, which does not interfere with the normal use of the tether. A number of attachment means for the golf ball are provided to permit ready replacement of the golf ball, although one version provides for a permanently connected golf ball if desired. The attachment of the line to the golf ball itself is through a hole which is angled to insure that there is no interference of the line with the impact of the golf club on the golf ball.

DESCRIPTION OF THE DRAWINGS

FIG. 4, 5, 6 and 7 are various golf ball attachment means.

FIG. 7A is a side view of a stud used as part of the attachment means in FIG. 7.

DETAILED DESCRIPTION OF THE PREFERRED EMBODIMENTS

Figure 1:
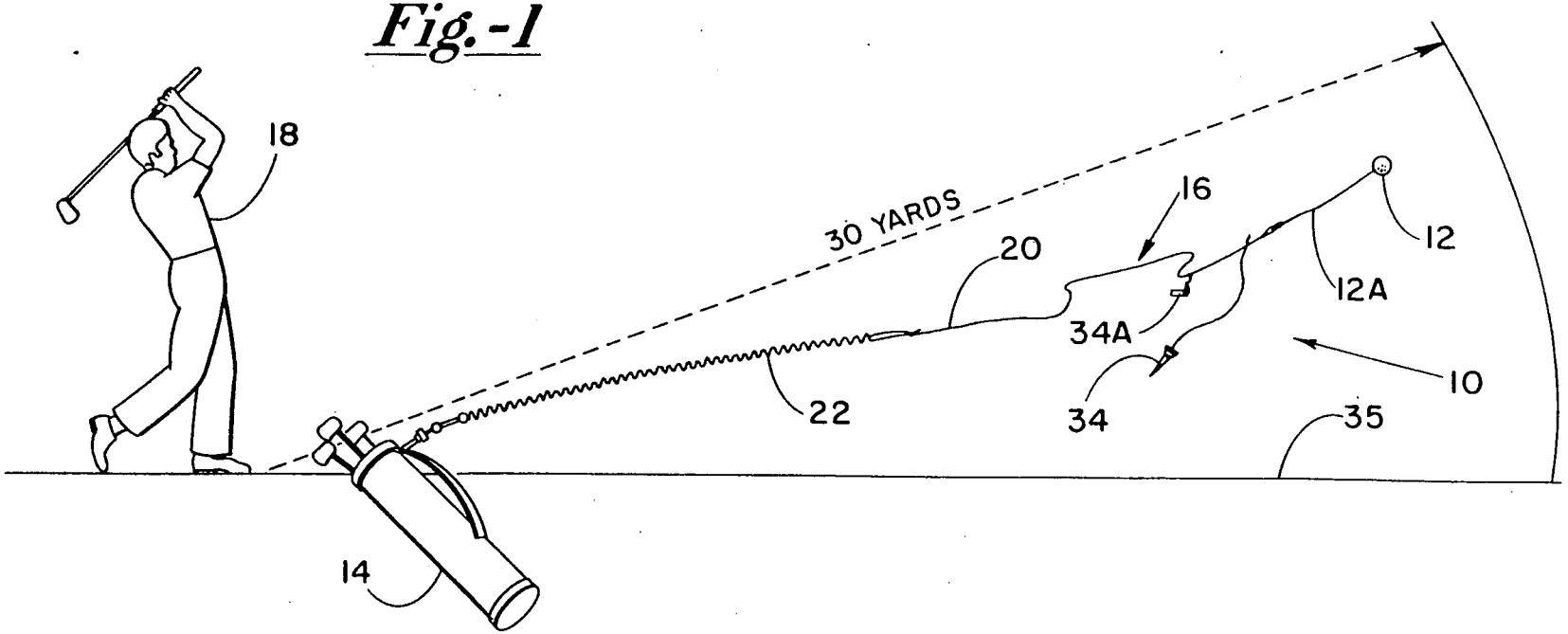
FIG. 1 is an overview of a first embodiment of the invention in use.

A first embodiment of a tethered golf sling 10 is shown in use in FIG. 1. A conventional golf ball 12 is attached to a golf bag 14 by a tether 16. A golfer 18 is shown having struck and moved ball 12 toward the end of tether 16 at approximately 30 yards. This distance of 30 yards is not critical but is representative of the distance which ball 12 will normally be tethered. This distance is adequate for a golfer to observe the trajectory of a ball but is limited enough to allow use of this apparatus in a relatively restricted area compared to the normal range of a struck golf ball. The use of golf bag 14 to restrain ball 12 permits this apparatus to be used where other tether attachment means is not convenient. Tether 16 can also be attached to any other convenient structure.

Figures 2, 2A:
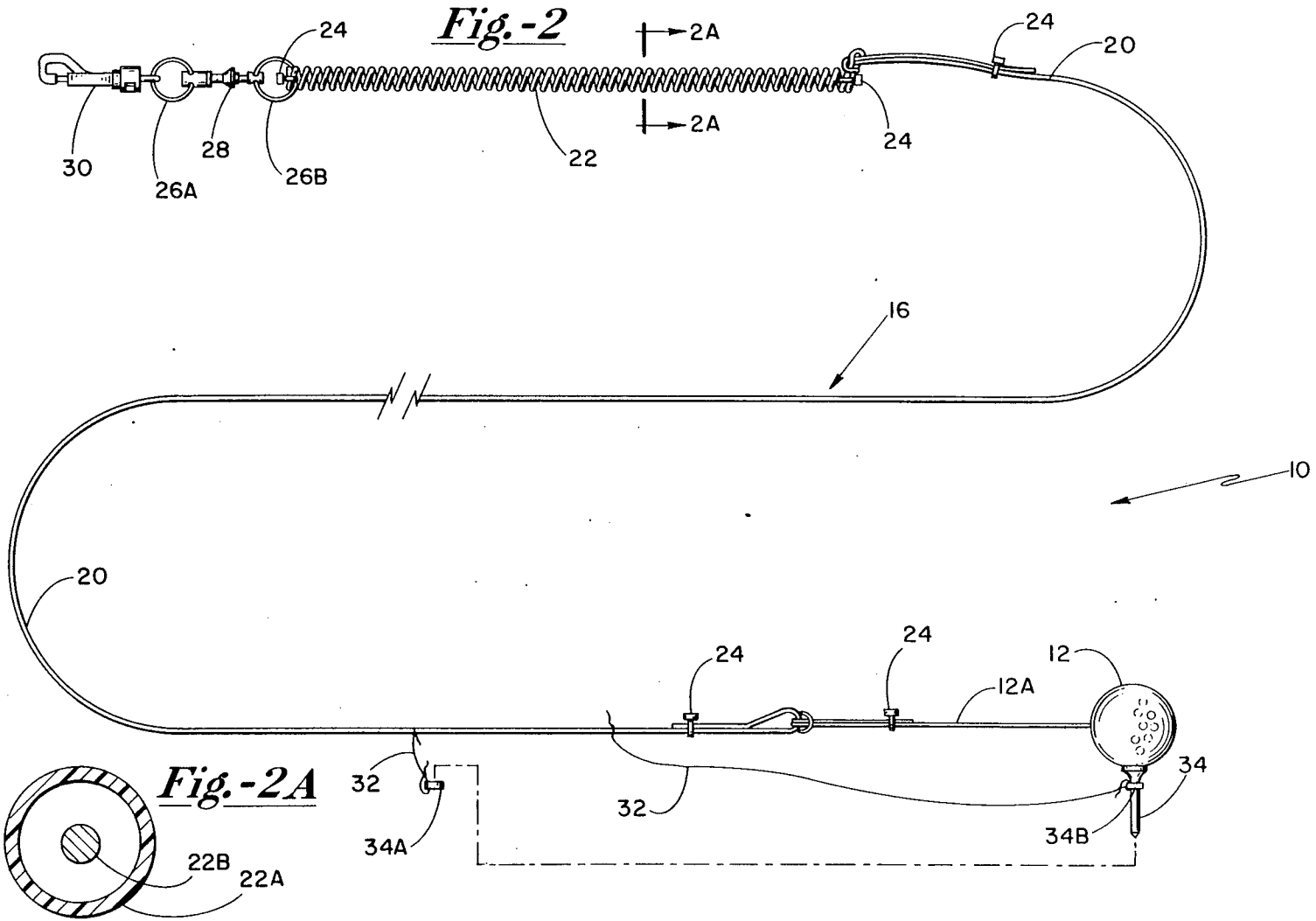
FIG. 2 is an overview of the first embodiment of the invention with the golf tee oriented to be secured into the ground.
FIG. 2A is a cross-section of a coil with an internal spring.

The first embodiment of tether 16 is made up of a number of individual sections which are shown in detail in FIG. 2. Tether 16 includes a flexible but non-stretchable cord 20, a line 12A which is attached to ball 12, and a coil 22.

Both ends of cord 20 are formed into a loop and each secured by a tie 24 for connection to coil 22 and line 12A respectively. Coil 22 which is secured by a tie 24 is also looped through the end loop of cord 20.

Ties 24 are of the type used to secure bundles of wire together into a cable. These are typically made of nylon with an integral structure to secure the tie in a loop.

Coil 22 is made of plastic material formed into a coil with a hollow interior. Coil 22 provides spring action to gradually stop the flight of ball 12 but allow the ball to reach the maximum travel permitted by tether 16. A refinement of coil 22, which can be used instead of an all plastic coil, is shown in the cross-section view of FIG. 2A. Here the outer plastic portion 22A of coil 22 surrounds an inner wire 22B. The use of an outer plastic portion 22A surrounding a said inner wire 22B provides a wide range of spring characteristics from the inner wire and a wide range of damping and resistive characteristics from by the outer plastic portion because each portion can be individually selected and tailored for any desired characteristic.

A second tie 24 on the opposite end of coil 22 secures that end of the coil to a closed ring 26B. A separable connector 28 is secured between this ring 26B and a second closed ring 26A. A snap 30 is also attached to closed ring 26A. Separable connector 28 is similar to the type of connector which permits attaching or removing an ignition key from other keys which combines a secure connection with a rapid means of disconnection.

Snap 30 is sized to permit attaching tether 16 to a golf bag 14 as shown in FIG. 1, or to a similar anchor means. Connector 28 is provided to permit disconnecting snap 30 and using other anchor means as will be described later.

One monofilament line 32 is tied to cord 20 with the opposite end tied to a ring 34A sized to closely fit a tee 34. A second monofilament line 32 secures a rubber ring 34B sized to hold tee 34. Ring 34B permits replacing a broken tee and ring 34A permits securing the tee close to line 16 when the tee is not in use. Tee 34 is carried along by cord 20 with ball 12 but the tee is so light that it has essentially no effect on the trajectory of the ball. Tee 34 permits the apparatus to be used with the driver which normally uses a teed up golf ball.

Golf ball 12 is attached to one end of line 12A using means which will be described later. The opposite and of line 12A is secured into a loop by tie 24. The loop is made large enough to accept golf ball 12A to permit securing the loop to the loop in the end of line 16 by a girth hitch.

Figure 2B:
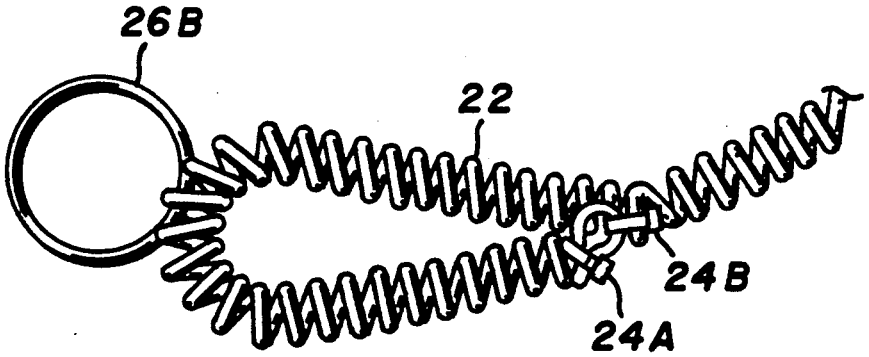
FIG. 2B is a modification to FIG. 2 showing adjusting means.

A method of connecting cord 20 to coil 22 to provide a means of adjusting the length of tether 16 is shown in FIG. 2B. Here coil 22 is folded through ring 26B. A tie 24A secures this end of coil 22 into a loop. A second tie 24B is connected through this loop and is formed itself into a loop which engages the coil. The loop formed by tie 24B is made large enough that it can be slid along coil 22 to any point along its entire length. Since this changes the amount that coil 22 is doubled this provides a length adjusting means.

The flexibility in selection of spring and damping characteristics in conjunction with the variable length adjustment permits optimizing the tether characteristics to match any requirements necessary to provide a realistic flight of ball 12 while still restricting the flight to a relatively short range. This length adjustment is important for different club selections because a wood golf club has a greater impact force than an iron golf club. Lengthening or shortening the tether for the greater or lesser impact clubs respectively tends to maintain the same flight characteristics for these various clubs.

Figure 3:
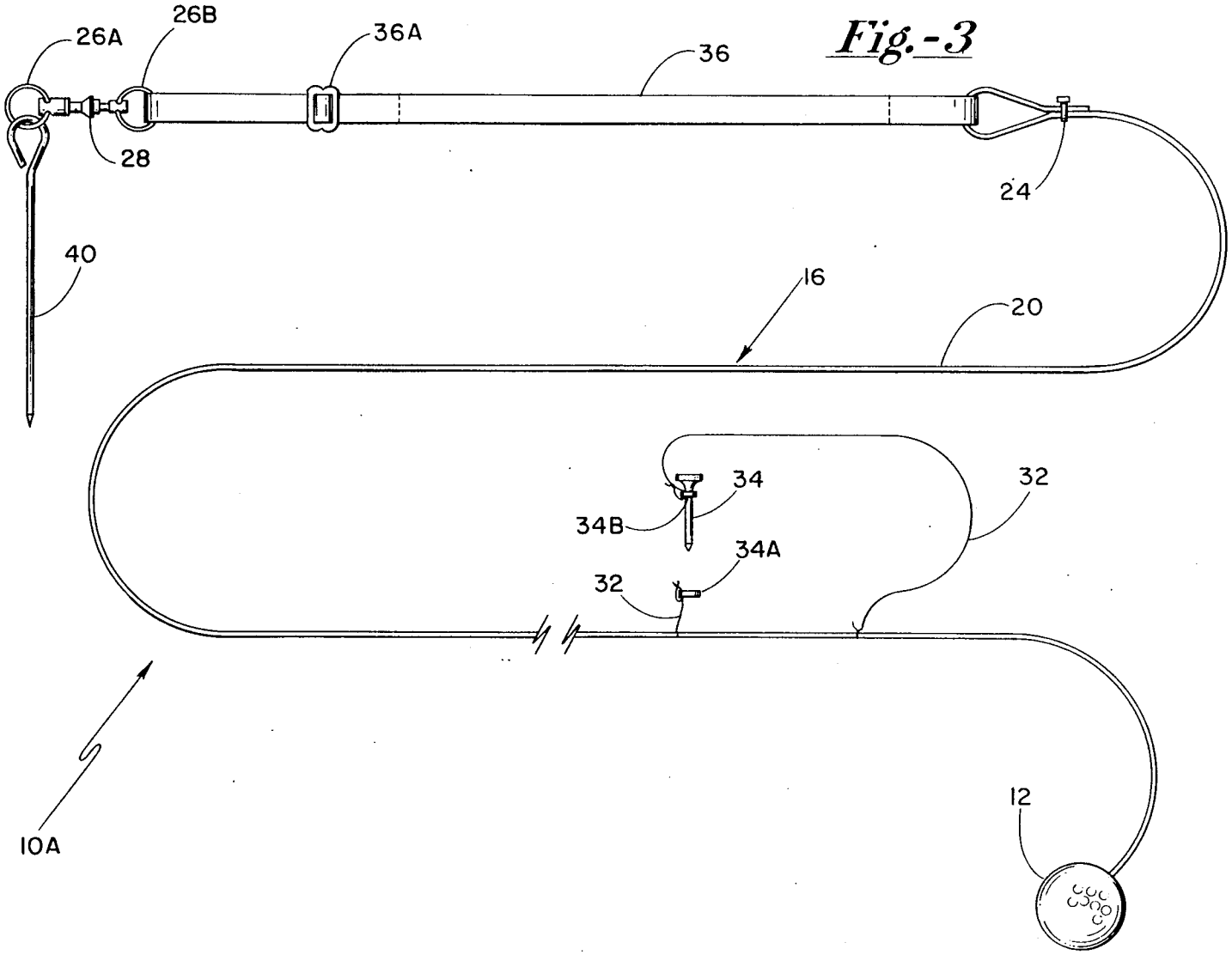
FIG. 3 is an overview of the second embodiment of the invention with a permanently attached golf ball.

A second embodiment of golf sling 10A is shown in FIG. 3. In this second embodiment the parts are essentially the same as the first embodiment and connected in the same way, excepting that here coil 22 is replaced by an adjustable elastic strap 36 and line 12A is omitted. This arrangement secures golf ball 12 permanently.

Elastic strap 36 provides the spring and damping effect for tether 16 but here the desired spring and damping characteristics are determined together by the characteristics of the strap. The end of strap 36 attached to cord 20 is doubled back and sewn to provide a loop for the looped end of cord 20. The opposite end of strap 36 is doubled back and secured by an adjusting buckle 36A which secures a loop through ring 26 and also provides a means for changing the length of strap 36. This ready means of adjustment of the length of strap 36 permits changing the length of the strap like coil 22.

Here connector 28 also attaches rings 26A and 26B together, however here a pin 40 is also secured to ring 26A. Pin 40 is sized to provide an anchor when forced into the ground. Separable connector 28 is used to provide a ready means of attaching tether 16 to either pin 40 for a ground anchor or to snap 30 for connection to a golf bag or similar anchor.

Ring 34A and ring 34B both sized to receive and secure the end of tee 34, are both attached to cord 20 by monofilament lines 32 as before.

Since golf ball 12 is a conventional golf ball it will have the usual flight characteristics of any golf ball excepting for the changes imposed by the tether requirements. These changes should be minimized to provide the best practice conditions in order to simulate the actual golfing experience. A critical requirement in attaching a line or cord to golf ball 12 is that none of the line or cord extends through the ball and thence outward on the opposite side, because the extending line or cord could be struck by a golf club and the flight of the ball changed from normal. FIGS. 4 through 7A illustrate a number of means to attach a line which meet this requirement.

As shown in FIGS. 4 through 7 all golf balls 12 have an identical inclined hole 42 therethrough communicating with an enlarged recess 44 opposite the line. Hole 42 is inclined to insure that a golf club will strike some portion of golf ball 12 other than the end of the hole to obtain more repeatable results.

In FIGS. 4 and 5 the attachment to ball 12 is made by a cord 20A. In FIG. 4 cord 20A extends through hole 42 and is secured within recess 44 by a knot in the end of the cord with the opposite end secured by a tie 24 into a loop large enough to accept golf ball 12. The knot in the end of cord 20A is too large to pass through hole 42 which secures the cord to golf ball 12.

In FIG. 5 cord 20 A has an identical loop, not shown, with the opposite end extending through hole 42 and secured within recess 44 by having the end of the cord melted after installation and formed into an enlarged end larger than hole 42 to secure the cord to golf ball 12. This requires that cord 20A be made of some form of plastic material which can be melted and formed into the necessary shape.

In FIGS. 6 and 7 line 12A is made up of multiple strands of fine lines. In FIG. 6 the ends of line 12A within recess 44 are knotted together into a knot which will not pass through hole 42 to secure the line to golf ball 12 with the opposite end secured into a loop large enough to accept golf ball 12 by a knot.

In FIG. 7A a stud 46 having an enlarged mushroom shaped top and cylindrical shaped body with a radial hole therethrough is shown. The body of stud 46 is small enough to fit into hole 42 while the head is small enough to fit into recess 44 but not into hole 42.

In FIG. 7 stranded line 12A is shown attached to golf ball 12 by securing the end of the stranded line through the hole in stud 46 to secure the end of the line to the stud with the stud located within recess 44 and hole 42. Since the head of stud 46 is larger then hole 42 line 12A is secured within golf ball 12. The opposite end of line 12A, not shown, is the same as in FIG. 6.

Holes 42 and recess 44 are relatively small to minimize the effect on the flight of ball 12 and both cord 20A and stranded line 12A made light enough that the effect on the flight of the ball will be minimized. In all cases recess 44 insures that nothing projects above the surface of golf ball 12 to be struck by a golf club and change the trajectory of the ball.

This golf sling by providing adjusting means for the resilient section, a means of selecting a spring constant separate from a damping constant, providing attachments for different anchors, a variety of golf ball attachment means, and an ever present tee, provides a realistic and convenient practice experience for the golfer.

While this invention has been described with reference to an illustrative embodiment, this description is not intended to be construed in a limiting sense. Various modifications of the illustrative embodiment, as well as other embodiments of the invention, will be apparent to persons skilled in the art upon reference to this description. It is therefore contemplated that the appended claims will cover any such modifications or embodiments as fall within the true scope of the invention.

I claim:

1. In golf practice apparatus of the type having a golf ball attached to an anchor by a tether having an elastic portion, the improvement comprising:

(a) said elastic portion of said tether being formed of material having a generally circular shaped cross-section fabricated into a coil shape having a series of generally uniform sized loops which advance along a center from loop to loop, said coil having two separate parts, an outer coiled part made of plastic having a hollow interior extending along the length of the coil, and an inner part made of coiled spring metal, said inner part being dimensioned and fabricated such as to fit within the hollow interior whereby said coiled spring metal and plastic provide a wide array of spring and damping characteristics, respectively.

* * * * *